US005562041A

United States Patent [19]

Ellens

[11] Patent Number: 5,562,041

[45] Date of Patent: Oct. 8, 1996

[54] LINEAR INDUCTION MOTOR ACTUATED STOP

[75] Inventor: Daniel S. Ellens, Brighton, Mich.

[73] Assignee: Jervis B. Webb Company, Farmington Hills, Mich.

[21] Appl. No.: 348,338

[22] Filed: Dec. 2, 1994

[51] Int. Cl.[6] ..... B61K 7/00; B61B 3/00

[52] U.S. Cl. ..... 104/251; 104/172.4; 104/252

[58] Field of Search ..... 104/162, 172.1, 104/172.2, 172.4, 249, 250, 251, 252, 253

[56] References Cited

U.S. PATENT DOCUMENTS

| | | | |
|---|---|---|---|
| 3,347,171 | 10/1967 | Torrance . | |
| 3,434,431 | 3/1969 | Dehne | 104/172.4 |
| 3,477,390 | 11/1969 | Dolding | 104/251 X |
| 3,799,436 | 3/1974 | Frasure . | |
| 3,800,710 | 4/1974 | Raoulx | 104/252 X |
| 3,995,561 | 12/1976 | Allor, Jr. | 104/250 X |
| 4,542,698 | 9/1985 | Wakabayashi | 104/172.4 X |
| 4,700,119 | 10/1987 | Karita . | |
| 4,704,568 | 11/1987 | Beck et al. | 318/135 X |
| 4,772,837 | 9/1988 | MacMunn . | |
| 4,890,023 | 12/1989 | Hinds et al. | 318/135 X |

*Primary Examiner*—Robert J. Oberleitner
*Assistant Examiner*—Kevin D. Rutherford
*Attorney, Agent, or Firm*—Gifford, Krass, Groh, Sprinkle, Patmore, Anderson & Citkowski, P.C.

[57] ABSTRACT

The present invention provides a carrier stopping device for a conveyor having a disengageable propelling member, such as a power and free conveyor. The stopping device preferably utilizes a linear induction motor to activate a stop plate of the stopping device. The stop plate is locked in an extended position and a retracted position by a locking pin which reacts to the electromagnetic force of the linear induction motor.

17 Claims, 2 Drawing Sheets

LINEAR INDUCTION MOTOR ACTUATED STOP

BACKGROUND OF THE INVENTION

I. Field of the Invention

The present invention relates to conveyor systems having disengageable load carriers and more particularly to a device for stopping and disengaging a carrier in such a system.

II. Description of the Prior Art

Conveyor systems, such as "power and free conveyors" have load carriers which may be selectively released from a propelling mechanism. A power and free conveyor includes a "power line" and a number of load carriers suspended on a carrier track. The "power line" includes a propelling mechanism for the carriers and is supported for continuous movement on a power track.

The "power line" is mounted adjacent to the carrier track. Load carriers are suspended from the carrier track on trolleys. Each trolley has a driving mechanism which engages a pusher of the propelling mechanism. The driving mechanism includes a retractable driving dog and a hold-back dog. The pusher is held between the dogs to propel the carrier.

Wayside stopping stations are provided to selectively disengage the pusher from the carrier and hold the carrier in position while an operation, such as loading or unloading, is performed. The carriers are disengaged from the pusher by extending a stop plate into the path of travel of the driving mechanism to retract or depress the driving dog. The stop plate, thus, releases the pusher and then abuts against a stop engagement surface to hold the carrier.

Previously known stopping devices utilized mechanical assemblies or pneumatic systems to extend and retract the stop plate. These assemblies operate at a relatively slow speed in extending and retracting the stop plate. In environments having dust, dirt, or other contaminants, it is necessary to carefully protect the mechanical assembly from clogging and jamming. Pneumatic systems are noisy and require extensive and expensive air supply systems and large compressors.

Accordingly, it would be advantageous to provide a simple and inexpensive stop assembly which is not sensitive to environmental conditions and which is rapidly extended and retracted.

SUMMARY OF THE PRESENT INVENTION

The invention provides an improvement in wayside stopping devices for conveyor systems having disengageable carriers. The improved stopping device includes a stop plate which is extended and retracted from a housing by operation of a linear induction motor (LIM). The LIM includes a stator and a reactor plate. The reactor plate is mounted on the stop plate adjacent to the stator. The stator is connected to a controller which provides electrical current to produce an electromagnetic force. The force may be controlled to selectively move the stop plate quickly and precisely in two reciprocal directions.

A magnetically actuated locking device for the stop plate is also provided. A lock pin is dropped from the stop plate into one of two locking holes in the housing. When the stator is energized, the lock pin is lifted from the locking hole by electromagnetic force to release the stop plate and LIM to move the stop plate. After the stop plate is moved and the LIM is deactivated, the lock pin is permitted to drop into a second hole in the housing to lock the stop plate in position.

Accordingly, the stopping device of the present invention may be precisely extended and retracted at a high velocity. The stopping device may be reliably used in situations which require quick release of the carrier from the propelling member. The stopping device has few movable parts and is subject to lower maintenance than other known devices. The stopping device may also be used effectively in environments having particulate contamination.

Other advantages and features of the present invention will become more apparent from the following detailed description when read in conjunction with the accompanying drawing.

BRIEF DESCRIPTION OF THE DRAWING

The present invention will be more fully understood by reference to the following detailed description of the preferred embodiments of the present invention when read in conjunction with the accompanying drawing, in which like reference characters refer to like parts throughout the views, and in which.

DESCRIPTION OF THE PREFERRED EMBODIMENTS

Figure 6:
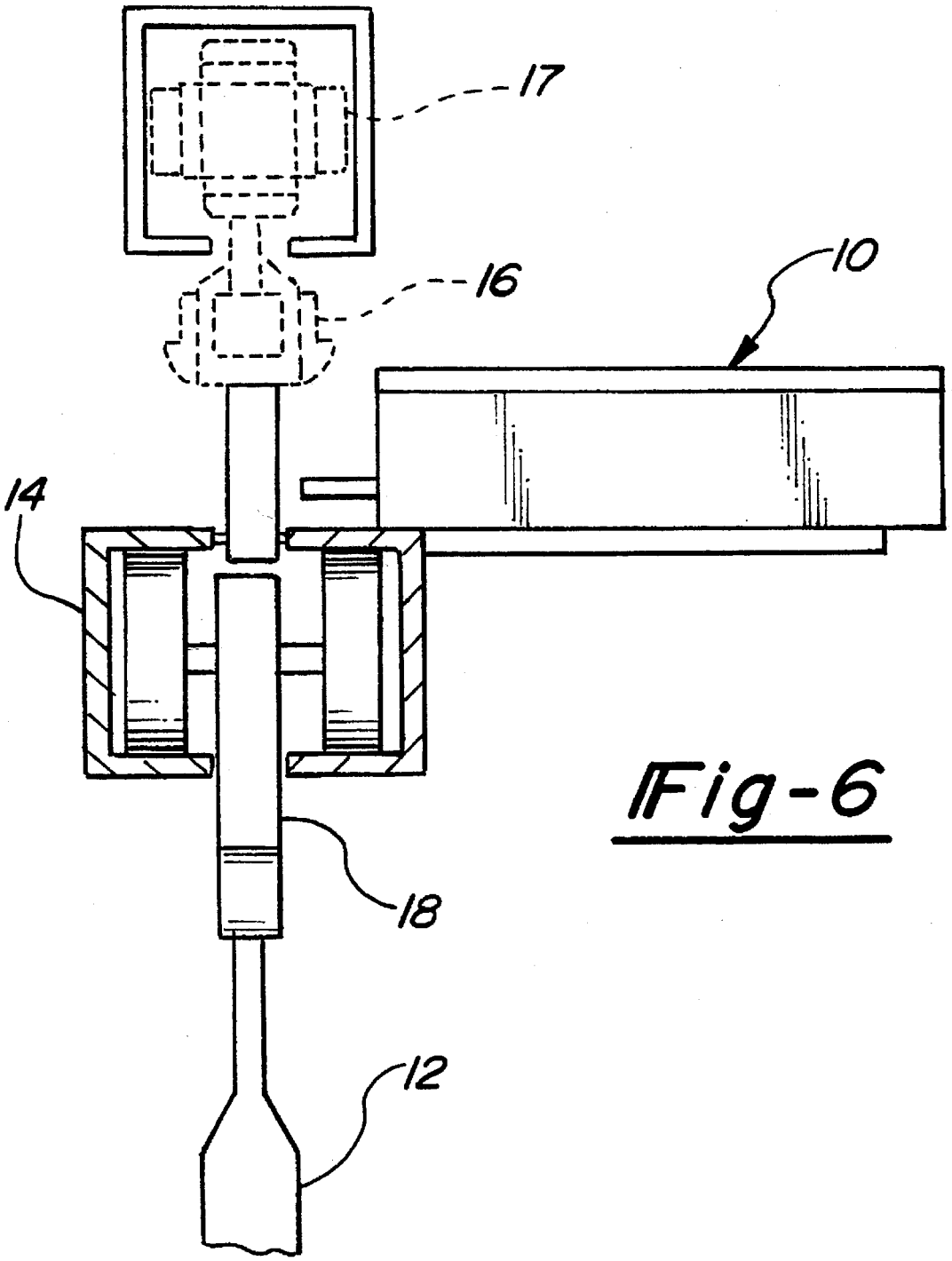
FIG. 6 is a side view of the stopping device and carrier in accordance with the invention.

With reference to FIG. 6, thereshown is a stopping device 10 for use with a conveyor system of the type having a load carrier 12 disengageable from a continuously moving propelling device. The stopping device is shown for use at a wayside stopping station of a "power and free" conveyor. The carrier 12 is propelled along a carrier track 14 by a pusher 16 of a propelling device 17. In a power and free conveyor, the propelling device 17 and pusher 16 are continuously driven along a conveyor track known as a "power line" (not shown).

Figure 1:
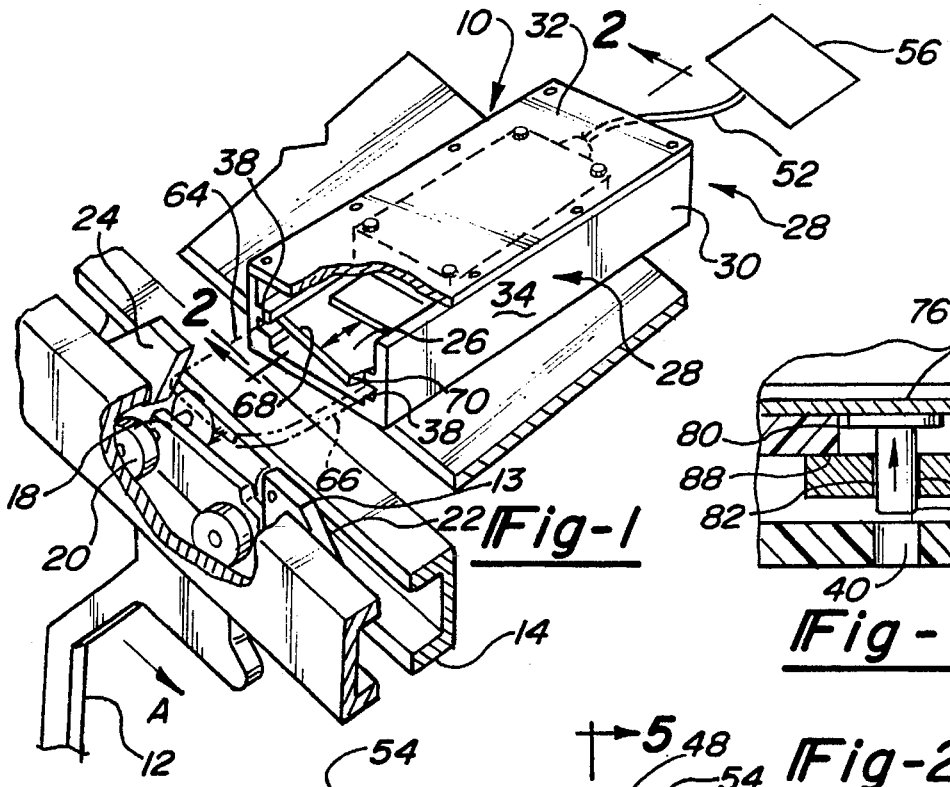
FIG. 1 is a perspective view illustrating a stopping device for a conveyor system in accordance with the present invention.

As shown in FIG. 1, the load carrier 12 is supported for movement on the carrier track 14 by a trolley 18 having four wheels 20. The trolley 18 and carrier 12 are moved in the direction of the arrow A along the track 14 by the pusher 16 which engages a driving mechanism mounted on the trolley 18. The driving mechanism includes a driving dog 22 and a hold-back dog 24. As is known in the art, and disclosed in U.S. Pat. No. 3,559,585, the driving dog 22 may be depressed to disengage the pusher 16 from the driving device and stop the trolley 18.

As shown in FIG. 1, the corner 13 is disengaged by the stopping device 10. The stopping device 10 includes a housing having a stop plate 26 which is movable outwardly from the housing 28 to depress the driving dog 22 and release the pusher 16 from the driving mechanism of the trolley 18. The housing 28 includes a U-shaped channel member 30 and a cover plate 32. The channel member may be formed in one piece as an extrusion or fabricated from bar and plate stock. The channel member 30 has a pair of side walls 34 extending upwardly from a bottom 36. As best shown in FIGS. 1 and 5, each of the side walls 34 includes a longitudinal slot 38 formed between a pair of rails 39 to accept the stop plate 26 for sliding movement therein. The bottom 36 of the housing 28 includes a pair of spaced apart holes 40, 41 (FIGS. 2 and 4) which are disposed on a longitudinal center line of the housing. The holes 40, 41 are formed to accept a locking pin 42 extending from the stop plate 26 as is discussed more fully below.

As shown in FIGS. 1 and 5, the cover plate 32 extends between the side walls 34 of the channel member 30. The cover plate is affixed to the channel member 30 in a suitable manner, such as machine screws 44. Mounted to an underside 46 of the cover plate 32 is a stator 48. The stator 48, together with a reactor plate 50 which is mounted on the stop plate 26 and a controller 56, form a linear induction motor (LIM).

The stator 48 is fixed to the cover plate 32 by four bolts and nuts 54 and is connected by a wire 52 to the controller 56 which is located at a suitable remote location. As is known, A/C currents are supplied from the controller 56 to the stator 48 to produce an electromagnetic field which may be moved linearly. The moving magnetic field interacts with the currents it induces in the reactor plate 50 to provide a driving force to the reactor plate 50 to move the stop plate 26. By controlling the phase order, frequency and magnitude of the A/C currents supplied to the stator 48, the controller can precisely control the velocity, acceleration and position of the reactor plate 50 and stop plate 26.

Figure 2:
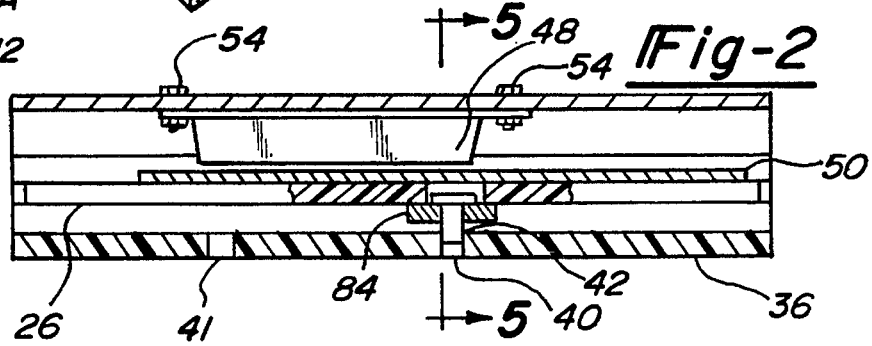
FIG. 2 is a longitudinal cross-section of the stopping device with a stop plate in a retracted position in accordance with the invention taken along line 2—2 of FIG. 1.
Figure 4:
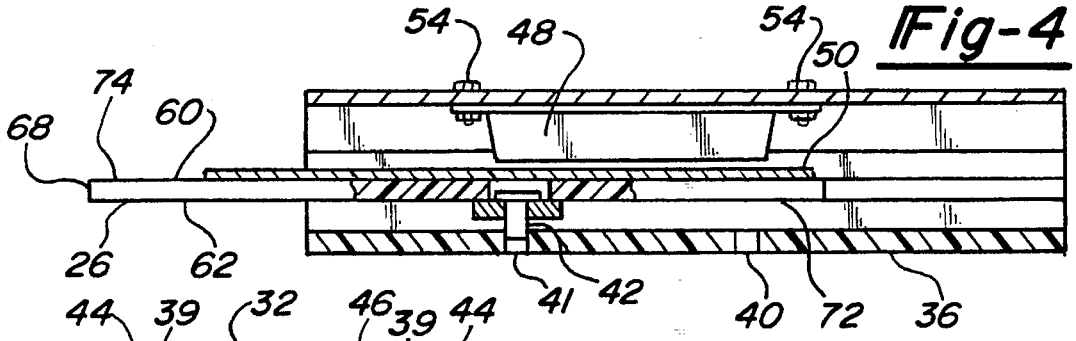
FIG. 4 is a longitudinal cross-sectional view of the stopping device with the stop plate in an extended position in accordance with the invention.
Figure 5:
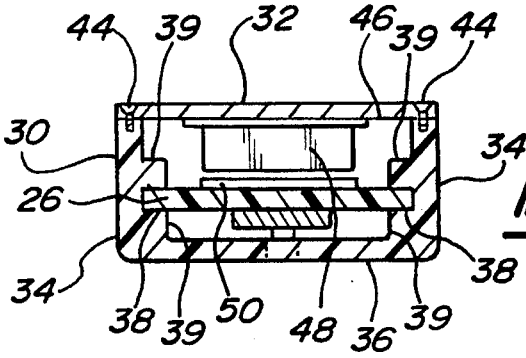
FIG. 5 is a cross-section of the stopping device in accordance with the invention taken along line 5—5 of FIG. 2.

As shown in FIGS. 1, 2 and 4, the stop plate 26 is mounted for sliding movement in the slots 38 of the side walls 34. The stop plate 26 is formed of a suitable rigid material, such as steel. The stop plate 26 has a top surface 60 and bottom surface 62 extending between a front side 64 which extends in a parallel relationship with a rear side 66. The rear side 66 has an edge portion 70 which angles inwardly from the rear side 66 to an outer edge 68. The stop plate has an inner portion 72 positioned within the housing 28 and an outer portion 74 extending outwardly from the housing 28. The outer portion 74 of the stop plate 26 is formed to engage and depress the driving dog 22 to release the pusher 16. The outer edge 68 of the stop plate 26 is angled outwardly with respect to the housing from the front side 64 and the rear side 66.

Figure 3:
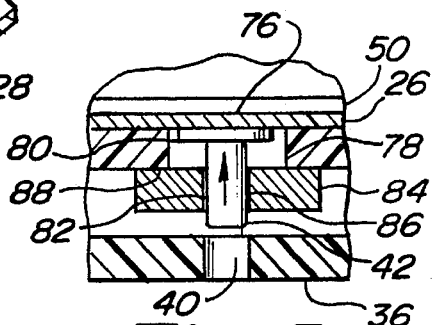
FIG. 3 is a fragmentary view of a locking device shown in an unlocked position in accordance with the invention.

As best shown in FIG. 3, the reactor plate 50 is mounted to the top surface 76 of the inner portion 72 of the stop plate adjacent the stator 48. The reactor plate 50 is of a known type suitable for influence by the magnetic force of the stator.

A throughbore 78 is formed in the stop plate beneath the reactor plate 50 for accepting the locking pin 42. The locking pin 42 has a head 80 and a downwardly extending cylindrical portion 82. A keeper plate 84 having a throughbore 86 is mounted to the bottom surface 88 of the stop plate. The throughbore 86 of the keeper plate has a diameter larger than the cylindrical portion 82 of the locking pin 42 but smaller than the outer diameter of the head 80 to maintain the head 80 of the locking pin 42 within the throughbore 86 of the stopping plate 26. The locking pin 42 is formed of a magnetic material, such as steel.

As shown in FIG. 2, when the stop plate is in a retracted position, the locking pin 42 rests on the keeper plate 84 in the locking hole 40 in the bottom of the housing. As shown in FIG. 4, the locking pin 42 is positioned in locking hole 41 to lock the stop plate 26 in an extended position for disengaging the pusher 16 of the load carrier 42.

When the stator 48 is energized, the locking pin 42 is drawn upward by the magnetic force of the stator and withdrawn from one of the holes 40, 41 of the housing, as shown in FIG. 3, to release the stop plate and permit the linear induction motor to thrust the reactor plate 50 and stop plate 26 in the desired direction.

The operation of the stopping device is controlled by the controller 56. To engage the pusher 16 with the load carrier 12, the stator 48 is energized to lift the lock pin 42 from the hole 41 and move the stop plate 26 to the retracted position as shown in FIG. 2. When the stator is deactivated the locking pin 42 falls into hole 40. To disengage the carrier, the stator 48 is reactivated by the controller 56. The locking pin 42 is again attracted to the stator which then causes the stop plate 26 to move to the extended position, shown in FIG. 4. Upon deactivation of the stator 48, the locking pin 42 drops down into a locked position within hole 41 of the channel member 30.

Having described my invention, however, many modifications thereto will become apparent to those skilled in the art to which it pertains without deviation from the spirit of the invention as defined by the scope of the appended claims.

I claim:

1. A stopping device for a conveyor system having a carrier selectively engageable with a propelling member, said stopping device comprising:

a housing;

a stop plate slidably mounted to said housing for disengaging said propelling member from said carrier; said stop member reciprocally movable between an extended position and a retracted position;

a reactor element mounted to said stop plate and a linear induction motor having a stator for moving said stop plate between said extended position and said retracted position; and means for selectively locking said stop member in said extended position and said retracted position.

2. The carrier stopping device defined in claim 1, said selectively locking means further comprising a steel pin.

3. The carrier stopping device defined in claim 2, said housing further comprising a pair of holes formed for accepting said locking pin.

4. The carrier stopping device defined in claim 1, said locking means further comprising magnetic means reactive to said linear induction motor.

5. The carrier stopping device defined in claim 1, said stop plate further comprising means for supporting said selectively locking means in said activated position.

6. The carrier stopping device defined in claim 1, said housing further comprising a U-shaped channel having means for slidably supporting said stop plate.

7. A carrier stopping device for a conveyor having a carrier and a propelling member, said stopping device comprising:

a housing;

a stop member mounted within said housing for disengaging said propelling member from said carrier; said stop member reciprocally movable between an extended position wherein said stop member is in contact with said carriage and a retracted position; and a linear induction motor operable to magnetically move said stop member between said extended position and said retracted position, said linear induction motor having a reactor element mounted to said stop plate and movable relative to a stator.

8. The carrier stopping device as defined in claim 7, further comprising a means for selectively locking said stop member in said extended and retracted positions.

9. The carrier stopping device defined in claim 8, said selectively locking means further comprising means reactive to said linear induction motor.

10. The carrier stopping device defined in claim 9, said stop plate further comprising a keeper plate to support said locking pin.

11. The carrier stopping device defined in claim 8, said magnetic means further comprising a steel pin.

12. The carrier stopping device defined in claim 7, said linear induction motor assembly further comprising:

a primary electrically energized stator; and a reactor element spaced apart from said stator and movable relative to said stator; wherein said reactor element is fixedly attached to said stop plate.

13. The carrier stopping device defined in claim 7, said housing unit further comprising a U-shaped channel having means for slidingly supporting said stop member.

14. A carrier stopping device for a conveyor having a carrier and a propelling member, said stopping device comprising:

a stop member for disengaging said propelling member from said carrier; said stop member reciprocally moving between an activated position and a deactivated position;

control means having a linear induction motor for moving said stop member between said activated position and said deactivated position; and a member magnetically movable with respect to said stop member for locking said stop member in said activated position and said deactivated position.

15. The carrier stopping device defined in claim 14, said stop member further comprising a stop plate slidable between said activated position and said deactivated position.

16. The carrier stopping device defined in claim 14, said locking member further comprising a pin movable with respect to said stop member to selectively lock said plate.

17. The carrier stopping device defined in claim 14, said linear induction motor assembly further comprising:

a stator; and a reactor element spaced apart form said primary element and movable relative to said primary element; wherein said reactor element is fixedly attached to said stop member.

* * * * *